United States Patent [19]

Borck et al.

[11] Patent Number: 5,011,014

[45] Date of Patent: Apr. 30, 1991

[54] PACKAGING FOR ARTICLES, IN PARTICULAR THOSE HAVING A RIGHT PARALLELEPIPED SHAPE

[75] Inventors: Gerald-Wolfgang Borck, Ludwigshafen; Manfred Ell, Rheinau; Hans-Dieter Erhardt, Renchen, all of Fed. Rep. of Germany

[73] Assignee: BASF Aktiengesellschaft, Ludwigshafen, Fed. Rep. of Germany

[21] Appl. No.: 515,646

[22] Filed: Apr. 24, 1990

Related U.S. Application Data

[63] Continuation of Ser. No. 321,061, Mar. 9, 1989, abandoned.

[30] Foreign Application Priority Data

Mar. 10, 1988 [DE] Fed. Rep. of Germany ... 8803229[U]

[51] Int. Cl.[5] ..... B65D 85/672; B65D 3/26; B65D 65/26; B43M 7/00

[52] U.S. Cl. ..... 206/387; 206/605; 206/608; 206/633; 206/613

[58] Field of Search ..... 206/813, 613

[56] References Cited

U.S. PATENT DOCUMENTS

| | | | |
|---|---|---|---|
| 2,079,328 | 5/1937 | McBean | 206/613 X |
| 2,213,758 | 9/1940 | Eichberg et al. | 206/631 |
| 2,864,547 | 12/1958 | Guyer | 206/622 X |
| 3,360,182 | 12/1967 | Gunn | 229/51 |
| 3,442,436 | 5/1969 | Kirby, Jr. | 229/51 |
| 4,491,224 | 1/1985 | Horvath | 206/608 X |

FOREIGN PATENT DOCUMENTS

| | | | |
|---|---|---|---|
| 206806 | 12/1986 | European Pat. Off. | 206/813 |
| 2123376 | 2/1984 | United Kingdom | 206/387 |

*Primary Examiner*—William I. Price
*Attorney, Agent, or Firm*—Keil & Weinkauf

[57] ABSTRACT

Film packaging for right parallelepiped articles, in which the film parts are welded by heat sealing, is provided with a tear aid in the form of an additional, advantageously arranged imprint which prevents heat sealing in one or more desired areas. The reliability of film removal is additionally increased by means of a plurality of oblique prints and imprint areas one covering the other. The packaging can be used for articles of all types where complete removal of all packaging parts is necessary, for example for tape cassettes, in particular for magnetic tape cassettes.

13 Claims, 2 Drawing Sheets

Figure 1A:
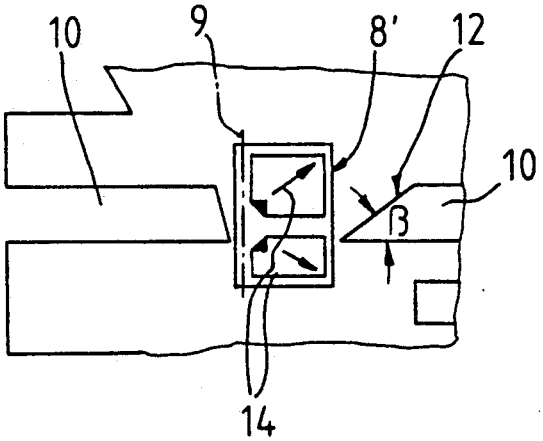

FIG.3
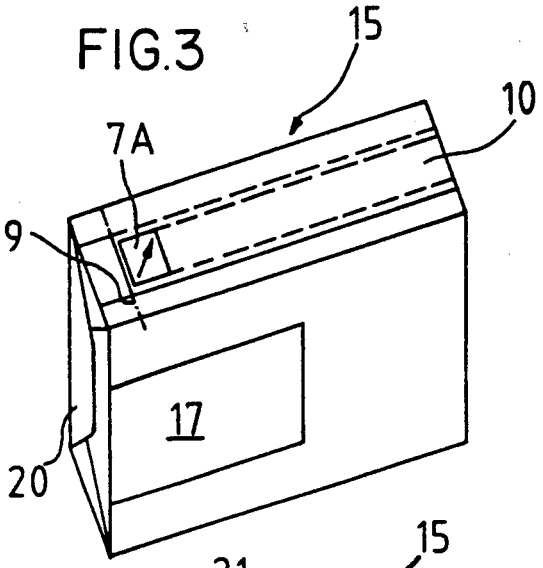
FIG.2
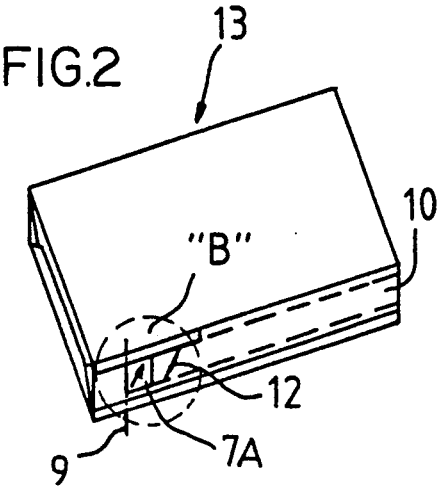
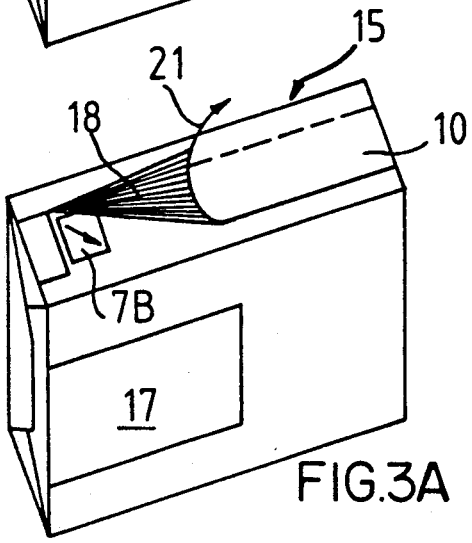
FIG.3A
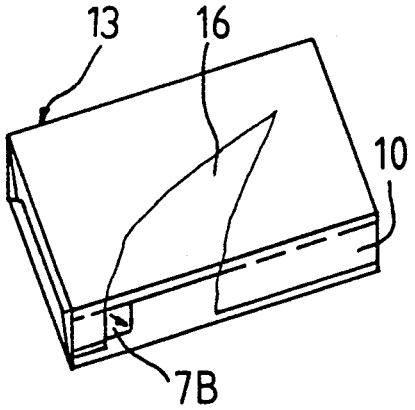
FIG.2A
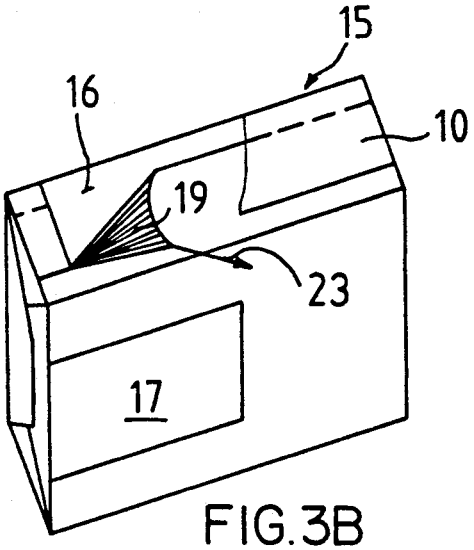
FIG.3B
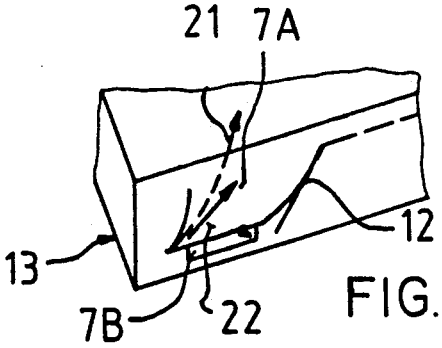
FIG.2B

PACKAGING FOR ARTICLES, IN PARTICULAR THOSE HAVING A RIGHT PARALLELEPIPED SHAPE

This application is a continuation of application Ser. No. 321,061, filed on Mar. 9, 1989 now abandoned.

The present invention relates to packaging for articles, in particular those having a right parallelepiped shape, consisting of film material which, in the form of a substantially closed film envelope, encloses the individual articles and/or a plurality of articles relatively tightly, the film envelope being provided at least with tear means and being partially printed and being produced by joining unprinted surfaces of the film material by the heat sealing method, and a film tape blank for such a packaging and an article, in particular a tape cassette, having such a packaging.

German Utility Model 8715168 discloses film packaging having a tear aid consisting of a tear thread, in which a perforation is additionally provided at an angle to, and close to, the parting line of the tear thread, the said perforation being intended to facilitate tearing and tearing open of the residual envelope. The necessity of having to use a film with a tear thread and the additional introduction of the perforation are expensive. This known packaging is an unprinted transparent film envelope, for example of polypropylene.

Film envelopes consisting of printed film material and intended for magnetic tape cassettes are known, the said envelopes being provided at the periphery with unprinted (sealing) edge strips for heat sealing. The sealing edge strip can be provided with a cut-out for gripping the tear thread. Gripping is nevertheless difficult, since the cut-out is, as a rule, very small in order that the visual appearance of the packaged cassette is altered as little as possible, and since the grip tab of the tear thread is frequently also firmly sealed in the sealing process.

It is an object of the present invention to provide an effective and economical tear aid which permits even the residual envelope of articles, in particular magnetic tape cassettes, which are welded, in particular by means of polypropylene film, to be removed without effort.

We have found that this object is achieved by packaging for articles, consisting of film material which, in the form of a substantially closed film envelope, tightly encloses the articles, the film envelope being provided with tear means and being at least partially printed and being provided with heat-sealing means for joining unprinted surfaces of the film material if the tear means comprises a tear part which consists of at least part of the film and carries printing on the film surface to be heat-sealed and in the proximity of which at least one tear line is provided. The reference to "articles" herein is meant to include both the case in which a given packaging encloses an individual article and the case in which it encloses a plurality of articles.

Consequently, the unpacking the case of partly or completely printed, heat sealed film envelopes, which not only may damage the packaged article but also may cause annoyance to the person wishing to unpack the article, is solved in a surprisingly simple and very economical manner. In particular, the use of tear threads or strips can be completely dispensed with. Moreover, the packaging has a satisfactory appearance prior to the tear operation, without rolling up of parts of the film, etc.

In another embodiment of the invention, a boundary line of a print, which boundary line runs at an angle to the tear line, may expediently be provided adjacent to the tear part, and the film surface behind the boundary line may be unprinted.

This means that a desired and effective tear direction can be predetermined in a simple manner without further measures and without it being necessary to have a special tear or opening instruction on the package.

In an advantageous embodiment of the invention, two tear parts can be arranged substantially one covering the other on the film envelope, so that it is possible to enable a first tear attempt to be followed by a second, more successful one.

In another embodiment, the imprint and/or the print can be provided on both tear parts.

The achievement according to the invention is particularly advantageous where the film material is polypropylene film, which is particularly strong and tough and which usually can be torn and hence removed only after incision or scoring, which in turn requires the presence of a tool.

The angle $\beta$ of the boundary line should be from about 80° to about 10° to the tear line.

The method of packaging is advantageously used for a film material whose tensile strength or ultimate tensile strength of the film is about 120–180N/mm$^2$ in the longitudinal direction and from about 140 to about 240N/mm$^2$ in the transverse direction.

A film tape blank for novel packaging is advantageously formed such that each imprint of the tear part is arranged between two cohesive film blanks, overlapping the particular parting line between the two film blanks.

The article having the novel packaging, for example one or more tape cassettes, has a greatly increased utility value as a result of the invention. A tape cassette having packaging whose film material consists of a 15–40 $\mu$m, preferably 30 $\mu$m, thick polypropylene film is advantageous.

Embodiments of the invention are shown schematically in the drawing and described below.

Figure 1:
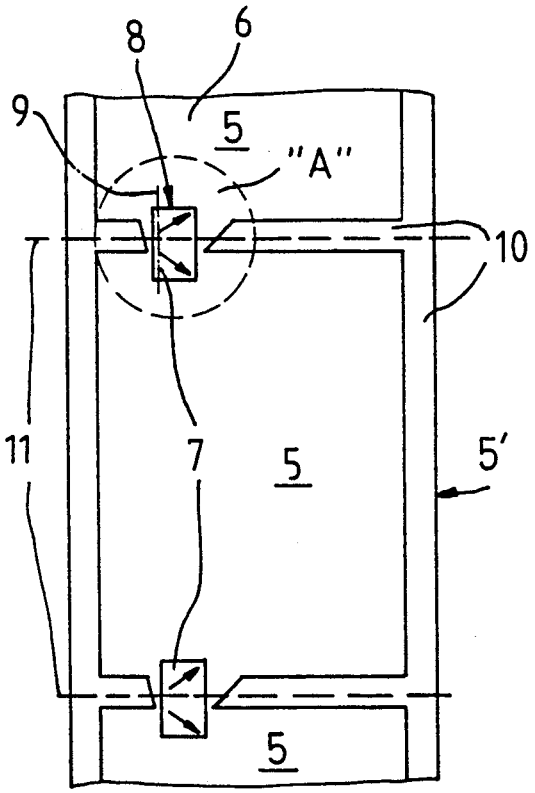

FIG. 1 shows a film tape blank for packaging according to the invention, A shows a detail from FIG. 1, FIG. 2 shows a tape cassette with the closed packaging, FIG. 2A shows a tape cassette with only partially removed packaging, FIG. 3 shows a unit consisting of a plurality of tape cassettes in common, closed packaging, FIG. 3A shows the unit from FIG. 3 after the upper tear part has been pulled up, FIG. 3B (2B) shows a unit consisting of one or more tape cassettes with only partially removed packaging after the lower tear part has been pulled up, and B shows a detail during opening of the tape cassette from FIG. 2.

FIG. 1 shows two joining points (7, 8) between three film blanks 5' for tape cassettes. 11 denotes the parting lines between the individual blanks 5', which are usually parted during or after the packaging process by means of a cutting apparatus. Each blank 5' consists of the outer contour lines between the parting lines (11) and is therefore composed of a printed area 5 and heat sealing zones 10 which surround the printed area 5, except for one point (7, 8), in the form of a frame. The tear aids in the form of tear parts 7 (7A and 7B are the upper and lower tear parts), which aids belong to a blank 5', are provided at the said point in the region of each parting line 11, for the still connected blanks 5'. These tear parts 7 are each formed by an imprint 8 precisely on the film surface which is intended for heat sealing by means of a sealing stamp.

In this example of tape cassette packaging, the print is located on the inside of the film, which faces the cassette.

As shown in the Examples of FIG. 1 and of detail A, the imprint 8, 8' consists of a tear instruction, each of which indicates the recommended tear direction by means of an arrow. Both diagrams also show that, in addition to the rectangular tear instruction (imprint 8, 8'), a further print is present, which ends with an oblique boundary line 12 (angle $\beta$ about 10°–80°), separating it from the unprinted sealing zone 10. This print, which may be of any form, results in the oblique line 12 simultaneously being the joining interface between the fused film surfaces after heat sealing. 9 indicates a tear line in the longitudinal direction on one side, in particular just within the imprint 8, the said tear line serving to initiate the tear operation. In a further embodiment, a further tear line could be provided in the direction of the boundary line 12, likewise essentially within the imprint 8.

The further embodiments are based on a single tear line 9 at right angles.

FIG. 2 shows, for example, a compact cassette in a conventional cassette box having printed cassette packaging which exhibits, on the long narrow face, the (upper) tear part 7A and the oblique print (boundary line 12) with an angle $\beta$ of about 45°.

Detail B shows a partially pulled up tab 22, whose shape is determined by the tear line 9 and the boundary line 12 (FIG. 2). The tear direction is indicated by arrow 21, and the lower tear part 7B, which is now ex-posed, is visible in addition to the upper tear part 7A. FIG. 2A shows the case where the tear operation was continued but only one film was torn off, this being indicated by the torn away cut-out 16. The lower tear instruction 7B was completely exposed in this procedure, so that the film can now be torn away, as shown in FIG. 2B for the cassette packaging 15, by means of the lower tear lobe 19, in tear-away direction 23, with the result that the residual packaging can now be completely removed.

FIG. 3 shows the multiple-cassette packaging 15 having upper tear part 7A and heat sealing zone 10 which, for example, can continue along the narrow side 20. 17 indicates a window within the printed film envelope.

During the initial tear operation on the unsealed upper tear lobe 18 (which may also be in the form of a tab, similar to 22 in FIG. 2, detail B), and tearing away in the direction of the arrow 21, the entire film envelope can be detached completely from the cassette or cassettes, so that it or they are accessible to the user. Where a film is parted, the complete removal of the residual packaging, which is then necessary, can also be effected according to FIG. 3B, as described above, by means of the reserve tear part 7B (on the lower tear lobe 19). It will be appreciated from the foregoing that a packaging has been disclosed in which the tear means comprises a tear part which is integral with the film and carries printing, in a predetermined location, on the side of the film to be heat-sealed, such that the printing which inherently prevents heat-sealing in that location, substantially delineates the area over which the tear takes place; and in which at least one tear line is provided in the proximity of that tear part.

The width of the tab 22 or of the tear lobe 18 is advantageously adjusted to normal finger width (about 1 cm).

The film material of the packaging examples described is, for example, polypropylene film, e.g. Bicor ®, MB400 (® is a registered trade mark of Mobil Oil Corporation), Technical Data Sheet 6 404/4/86 of Mobil Plastics Europe. The biaxially oriented film described therein has a relatively high tensile strength or ultimate tensile strength of 150N/mm$^2$ in the longitudinal direction and 220N/mm$^2$ in the transverse direction. The films for which the present invention has to be used are, however, generally characterized by a tensile strength of from about 120 to about 180N/mm$^2$ in the longitudinal direction and between about 140 and 240N/mm$^2$ in the transverse direction. Another decisive physical property is the edge tearing force, determined, for example, in the tear test according to DIN 7734 (October, 1958) and described in DIN 40,334 for insulating films. In the film with which the invention can be used, the edge tearing force should be not less than 150N, preferably about 150–250N.

The polypropylene film used for packaging tape cassettes had a thickness of about 15–40 $\mu$m, preferably 30 $\mu$m.

The packaging can also be used for one or more articles, in which case the articles together can have the shape of a right parallelepiped or of a roll.

The use of the invention is not restricted to packagings made of polypropylene films. Other films suitable for packagings of this type and consisting of other material, for example PVC or polyethylene, having similar strength and toughness characteristics, are likewise suitable for use in the novel packaging with double tear means.

The advantages of the invention were tested by 10 people using the same numbers of tape cassettes (compact cassettes) packed in polypropylene film, without the people having been informed beforehand about the measures of the invention. The result was that only the compact cassettes provided with the tear part(s) bearing the said imprint(s) could be opened, despite various efforts. Tools were not permitted.

We claim:

1. Packaging for articles consisting of film material which, in the form of a substantially closed film envelope, tightly encloses the articles, the film envelope being provided with tear means and being at least partially printed and being provided with heat-sealing means for joining unprinted surfaces of the film material, wherein the tear means comprises a tear part which is integral with the film and carries printing, in a predetermined location, on the side of the film to be heat-sealed, such that the printing which inherently prevents heat-sealing in said location, substantially delineates the area over which the tear takes place, and wherein one tear line is provided in the proximity of said tear part to initiate the tear.

2. Packaging as claimed in claim 1, wherein a boundary line of a printing, which boundary line runs at an angle to the tear line, is provided adjacent to the tear part, and the film surface behind the boundary line is unprinted.

3. Packaging as claimed in claim 1, wherein two tear parts are arranged substantially one covering the other on the closed film envelope.

4. Packaging as claimed in claim 1, wherein the printing contains at least one piece of information about the tear operation.

5. Packaging as claimed in claim 1, wherein the film material is polypropylene film.

6. Packaging as claimed in claim 1, wherein the edge tearing force of the film is at least 150N.

7. Packaging as claimed in claim 6, wherein the edge tearing force of the film is from 150 to about 250N.

8. Packaging as claimed in claim 1, wherein the boundary line is provided at an angle of from about 10° to about 80° to the tear line.

9. Packaging as claimed in claim 1, wherein the tensile strength of the film is about 120–180N/mm$^2$ in the longitudinal direction and from about 140 to about 240N/mm$^2$ in the transverse direction.

10. Packaging for articles, consisting of polypropylene film material having an edge tearing force of not less than 150N (Newton) which, in the form of a substantially closed film envelope, tightly encloses the articles, the film envelope being provided with tear means and being at least partially printed and being provided with heat-sealing means for joining unprinted surfaces of the film material, wherein the tear means comprises a tear part which consists of at least part of the film and carries printing on the film surface to be heat-sealed and in the proximity of which at least one tear line is provided.

11. Packaging as claimed in claim 10, wherein the tensile strength of the film is about 120–180N/mm$^2$ in the longitudinal direction and from about 140 to about 240N/mm$^2$ in the transverse direction.

12. A film tape blank for packaging as claimed in claim 1, comprising a plurality of film blanks for a plurality of film envelopes adjoining one another and being provided for subsequent separation along a parting line between two successive film blanks, wherein each printing of the tear part is arranged between the still unseparated film blanks, overlapping the particular parting line inbetween.

13. A tape cassette of right parallelepiped shape, having packaging consisting of polypropylene film material having a thickness of from 15 to 40 μm which, in the form of a substantially closed film envelope, tightly encloses the articles, the film envelope being provided with tear means and being at least partially printed and being provided with heat-sealing means for joining unprinted surfaces of the film material, wherein the tear means comprises a tear part which consists of at least part of the film and carries printing on the film surface to be heat-sealed and in the proximity of which at least one tear line is provided, and printing which has a boundary line with the unprinted part of the film surface is provided adjacent to the tear part, the said boundary line running at an angle to the tear line.

* * * * *